US007240643B1

(12) United States Patent
Perr et al.

(10) Patent No.: US 7,240,643 B1
(45) Date of Patent: Jul. 10, 2007

(54) PISTON COOLING NOZZLE AND POSITIONING METHOD FOR AN INTERNAL COMBUSTION ENGINE

(75) Inventors: Andrew P. Perr, Columbus, IN (US); Kristopher R. Bare, Columbus, IN (US); Marcus M. Chui, Franklin, IN (US)

(73) Assignee: Cummins, Inc., Columbus, IN (US)

( * ) Notice: Subject to any disclaimer, the term of this patent is extended or adjusted under 35 U.S.C. 154(b) by 0 days.

(21) Appl. No.: 11/403,441

(22) Filed: Apr. 13, 2006

(51) Int. Cl.
*F01P 1/04* (2006.01)

(52) U.S. Cl. ..... 123/41.35

(58) Field of Classification Search ..... 123/41.35
See application file for complete search history.

(56) References Cited

U.S. PATENT DOCUMENTS 4,508,065 A * 4/1985 Suchdev ..... 123/41.35
5,649,505 A 7/1997 Tussing ..... 123/41.35
6,832,437 B2 12/2004 Svensson ..... 29/890.143

* cited by examiner

*Primary Examiner*—Noah P. Kamen
(74) *Attorney, Agent, or Firm*—Sawyer Law Group LLP

(57) ABSTRACT

An internal combustion engine includes an engine block having an oil rifle. A cylinder liner carried by the engine block includes a bottom end. A piston cooling nozzle coupled with the engine block includes an inlet in communication with the oil rifle, a tube, and a bracket coupled with the tube. The bracket engages the bottom end of the cylinder liner.

19 Claims, 3 Drawing Sheets

PISTON COOLING NOZZLE AND POSITIONING METHOD FOR AN INTERNAL COMBUSTION ENGINE

BACKGROUND OF THE INVENTION

1. Field of the Invention

The present invention relates to internal combustion engines, and, more particularly, to piston cooling nozzles for cooling pistons in such engines.

2. Description of the Related Art

During operation of an internal combustion (IC) engine, a small percentage of the heat available in the fuel is absorbed by the pistons. While this percentage is only in the 3 to 8 percent range for aluminum alloy pistons, there is still a noticeable rise in the temperature of the pistons due to this heat absorption. While there is some heat transfer away from the pistons and hence some cooling, additional cooling is frequently needed to keep the piston temperature within a target operating temperature range. Heat is transferred via conduction heat transfer from the piston rings, land and skirt portions of the piston to the water jacket and crankcase oil. If higher than desired piston temperatures occur and there is insufficient cooling, the result can be increased crown, top land and top groove carbon deposits. As a general rule, top groove temperatures greater than 220° C. (428° F.) are considered excessive.

Under certain conditions it may be desirable to provide additional cooling of the piston to ensure satisfactory operation. One technique which is used to enable additional cooling by way of oil cooling is to provide a piston cooling nozzle (PCN) in combination with a specific piston design. The PCN has an inlet which receives oil at rifle pressure from the oil rifle in the engine block, and an outlet which directs cooling oil toward the piston resulting in a divergent, non-targeted plume of oil being sprayed onto the underside of the piston. The divergent, non-targeted spray results in some portion of the oil being sprayed against piston surfaces which are not critical and which are not the preferred surfaces for the most effective cooling and heat transfer. When the piston includes an undercrown cooling gallery, the preferred location for the plume of oil is directly into the cooling gallery. However, with a PCN having a divergent, non-targeted spray pattern, only a small portion of the cooling oil is actually sprayed into the gallery.

Another type of PCN provides a nozzle design that creates a targeted oil jet plume which is directed against the piston. With a targeted spray, it is easier to direct the spray to a localized and specific area of the piston such as a piston cooling gallery opening. An example of a targeted PCN is disclosed in U.S. Pat. No. 5,649,505 (Tussing), which is assigned to the assignee of the present invention and incorporated herein by reference.

With PCN designs utilized to date, the PCN orientation is determined by a special interface between the PCN and the engine block to which the PCN is mounted. The engine block is typically cast with an additional locating feature which interfaces with the PCN to properly orient the PCN. Since a casting process is not as accurate as a machining process, the proper orientation of the PCN can vary somewhat relative to the piston cooling gallery opening.

What is needed in the art is a piston cooling nozzle which is configured to be quickly and accurately located relative to an undercrown cooling gallery to ensure proper cooling of the piston.

SUMMARY OF THE INVENTION

The present invention provides a piston cooling nozzle with an integral bracket which engages a bottom end of a cylinder liner to properly locate a nozzle outlet relative to an undercrown cooling gallery.

The invention comprises, in one form thereof, an internal combustion engine including an engine block having an oil rifle. A cylinder liner carried by the engine block includes a bottom end. A piston cooling nozzle coupled with the engine block includes an inlet in communication with the oil rifle, a tube, and a bracket coupled with the tube. The bracket engages the bottom end of the cylinder liner.

The invention comprises, in another form thereof, a method of positioning a piston cooling nozzle relative to an undercrown cooling gallery of a piston in an internal combustion engine, including the steps of: positioning a mount of the piston cooling nozzle on an engine block such that an inlet of the piston cooling nozzle is in communication with an oil rifle in the engine block; locating a tube extending from the mount such that a bracket coupled with the tube engages a bottom end of a cylinder liner; and coupling the mount to the engine block.

An advantage of the present invention is that the piston cooling nozzle can be quickly and accurately located relative to an undercrown cooling gallery to ensure proper cooling of the piston.

Another advantage is that the piston cooling nozzle of the present invention can be used with new, rebuilt or repaired engines without additional modifications to the engine.

Yet another advantage is that the piston cooling nozzle of the present invention cools the piston sufficiently to prevent piston cracking and to meet target in-cylinder operating temperatures.

A further advantage is that the bracket of the piston cooling nozzle may be simply and inexpensively coupled with the tube, such as by brazing.

A still further advantage is that the piston cooling nozzle of the present invention minimizes dimensional stack-up tolerances by locating the piston cooling nozzle relative to machined surfaces, i.e., a machined opening in the engine block and the machined cylinder liner.

BRIEF DESCRIPTION OF THE DRAWINGS

The above-mentioned and other features and advantages of this invention, and the manner of attaining them, will become more apparent and the invention will be better understood by reference to the following description of an embodiment of the invention taken in conjunction with the accompanying drawings, wherein.

Corresponding reference characters indicate corresponding parts throughout the several views. The exemplification set out herein illustrates one preferred embodiment of the invention, in one form, and such exemplification is not to be construed as limiting the scope of the invention in any manner.

DETAILED DESCRIPTION OF THE INVENTION

Figure 1:
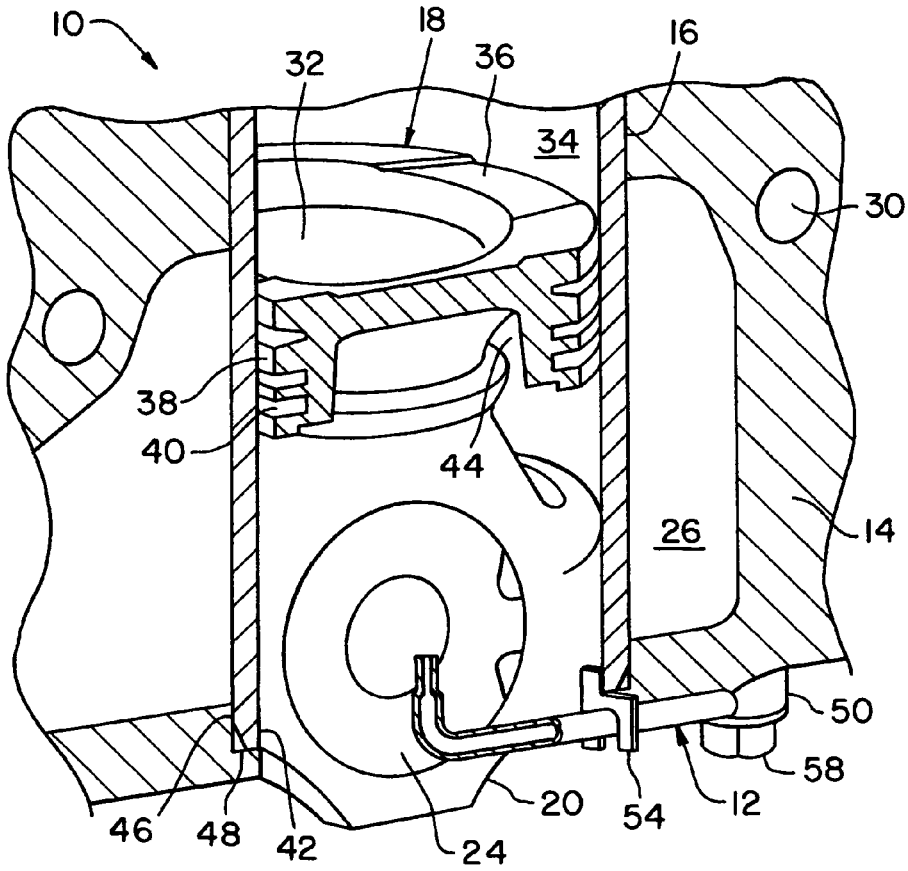
FIG. 1 is a fragmentary, perspective view of a portion of an internal combustion engine, including an embodiment of a piston cooling nozzle of the present invention.
Figure 2:
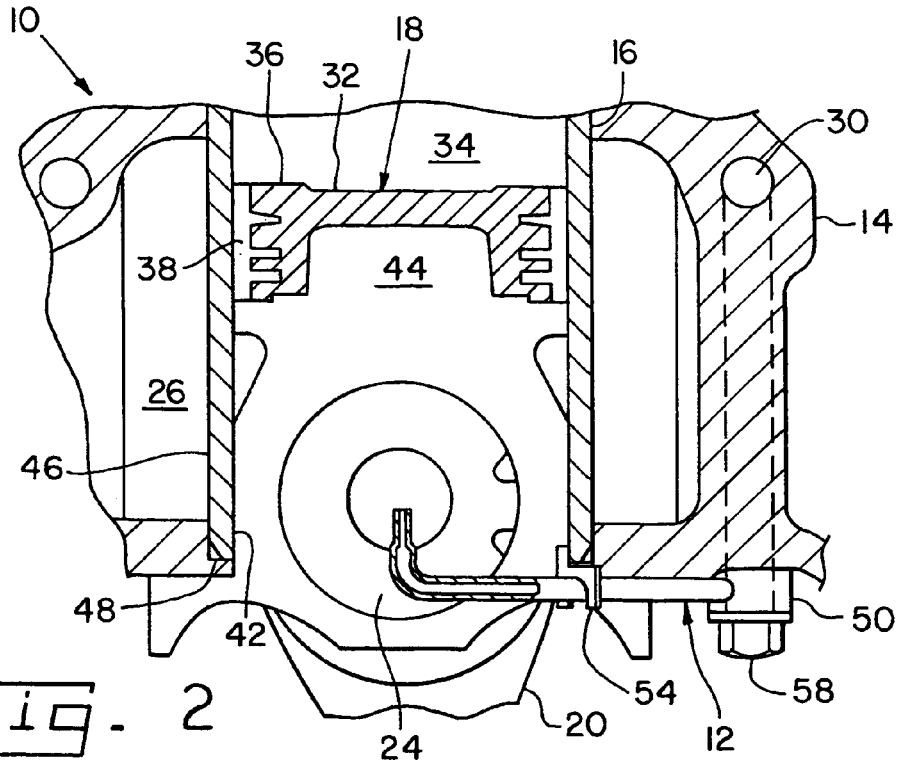
FIG. 2 is a fragmentary, side view of the internal combustion engine with piston cooling nozzle of FIG. 1.
Figure 3:
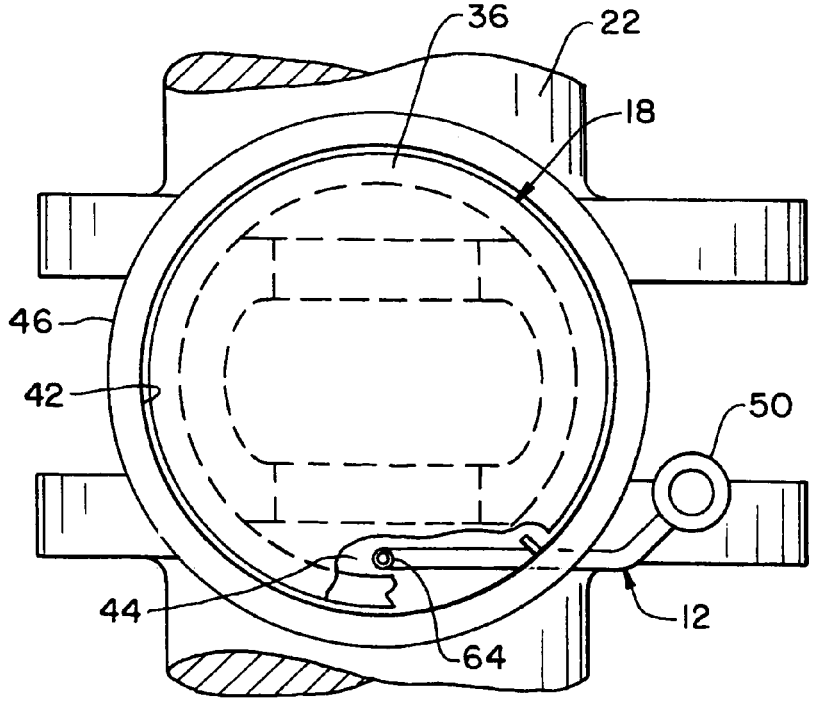
FIG. 3 is a fragmentary, top view of the internal combustion engine with piston cooling nozzle of FIG. 1.
Figure 4:
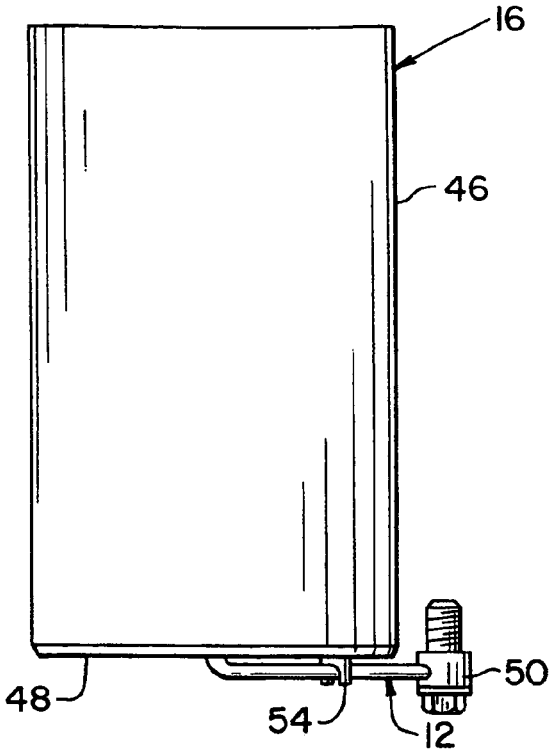
FIG. 4 is a plan view of the cylinder liner and piston cooling nozzle of FIGS. 1-3.

Referring now to the drawings, and more particularly to FIGS. 1-3, there is shown a portion of an IC engine 10, including an embodiment of a PCN 12 of the present invention. For simplicity sake, only a single piston and cylinder arrangement is shown in FIGS. 1-3. However, it is to be understood that IC engine 10 typically includes a plurality of piston and cylinder arrangements which are each connected with a common crankshaft. IC engine 10 may include, e.g., a number of combustion cylinders such as eight, ten or twelve combustion cylinders.

IC engine 10 generally includes an engine block 14, a cylinder liner 16, a piston 18 reciprocally carried within cylinder liner 16, a piston rod 20 interconnecting piston 18 with crankshaft 22, and a piston pin 24 interconnecting piston rod 20 with piston 18.

Engine block 14 includes a number of openings which are sized and configured to receive each of the respective cylinder liners 16 therein. Cylinder liners 16 are typically press fit into the openings within engine block 14. Engine block 14 is also configured to include a cavity 26 around each cylinder liner 16 forming part of an interconnected water jacket through which cooling fluid (such as an anti-freeze coolant mixture) is circulated for cooling of IC engine 10.

Engine block 14 also includes an oil rifle 30 providing oil at rifle pressure from an oil pump (not shown) for defined uses, such as for cooling and/or lubrication. Oil rifle 30 is in fluid communication with PCN 12, as will be described in further detail hereinafter.

Piston 18 includes a head end 32 which is contoured to promote efficient combustion of a fuel and air mixture within combustion chamber 34 as piston 18 travels between a bottom dead center (BDC) position and a top dead center (TDC) position. Head end 32 defines a peripheral crown 36 from which an annular skirt 38 extends. A plurality of piston ring grooves 40 carry a plurality of respective piston rings (not shown) which substantially fluidly seal between skirt 38 and inside diameter (ID) 42 of cylinder liner 16. An under-crown cooling gallery 44 located below crown 36 and radially within skirt 38 provides a target area for impingement of cooling oil from PCN 12, as will be described in further detail below.

Cylinder liner 16 has an ID 42 which is machined and honed to a desired diameter and surface finish for effective reciprocating movement of piston 18 therein. Cylinder liner 16 has an outside diameter (OD) 46 which is typically formed with different stepped surfaces allowing press fitting and substantial sealing within a corresponding opening in engine block 14. Cylinder liner 16 also includes a bottom end 48 which is used to properly orient PCN 12 relative to cooling gallery 44. The bottom end 48 of each cylinder liner 16 does not refer to some orientation of IC engine 10, but rather refers to the end of cylinder liner 16 which is closest to the BDC position of piston 18.

Referring now to FIGS. 4-8, PCN 12 will be described in greater detail. PCN 12 generally includes a mount 50, tube 52 and bracket 54. Mount 50 is in the form of a hollow cylindrical body made from a suitable material such as steel. The hollow interior 56 defines an inlet to PCN 12, and is sized to receive an externally threaded bolt 58 which is threadingly engaged with a corresponding internally threaded passageway in engine block 14 communicating with oil rifle 30. Bolt 58 is configured as a "banjo bolt" having an axial passageway and one or more depending radial passageways. Oil from oil rifle 30 flows through the passageways in bolt 58 and into hollow interior 56 of mount 50. Although mount 50 is shown as being bolted to engine block 14, it is also to be understood that mount 50 can be configured to allow a different method of coupling with engine block 14, such as by clamping or possibly press fitting.

Tube 52 has a proximal end 60 which is coupled with mount 50, and a distal end 62 which terminates at a nozzle outlet 64. In the embodiment shown, proximal end 60 is metallurgically bonded with mount 50, such as by brazing. Tube 52 is shown as including three generally straight sections interconnected by two primary bends, but may also be differently shaped depending upon the application. The particular size and shape of nozzle outlet 64 can also vary depending upon the application.

Bracket 54 is coupled with tube 52 at a predetermined location allowing bracket 54 to interface with bottom end 48 of cylinder liner 16 when installed. In the embodiment shown, bracket 54 is metallurgically bonded with tube 52 using a brazing process, which is the same process used to couple tube 52 with mount 50, thereby improving manufacturing efficiency.

Figure 8:
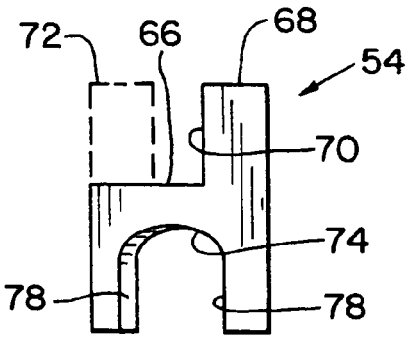
FIG. 8 is a front view of the bracket forming part of the piston cooling nozzle of FIGS. 5-7.
Figure 7:
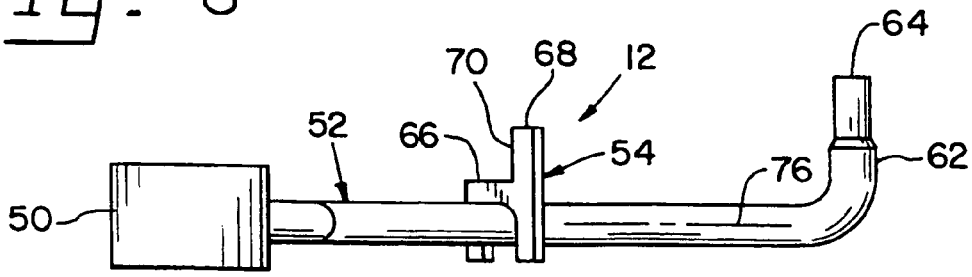
FIG. 7 is a side view of the piston cooling nozzle of FIGS. 5 and 6.

Bracket 54 has a generally h-shaped configuration, as shown in FIG. 8. Bracket 54 includes an edge 66 with a projection 68 which engages bottom end 48 of cylinder liner 16. More particularly, projection 68 includes a side wall 70 which engages ID 42 of cylinder liner 16 when nozzle outlet 64 is properly oriented relative to cooling gallery 44. Bracket 54 may optionally include a second projection 72 (shown in phantom lines in FIG. 8) such that bottom end 48 of cylinder liner 16 is captured between projections 68 and 72.

Bracket 54 also includes an opposing edge 74 with a shape which generally corresponds to the outer wall of tube 52. In the embodiment shown, opposing edge 74 has a generally semi-circular shape corresponding to the cylindrical shape of tube 52.

Figure 6:
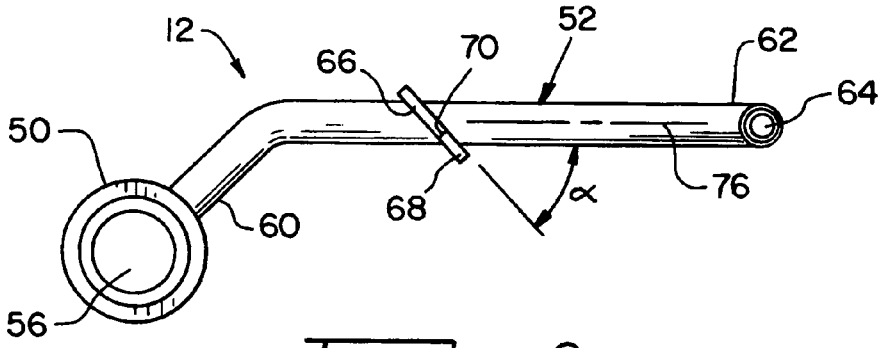
FIG. 6 is a top view of the piston cooling nozzle shown in FIG. 5.
Figure 5:
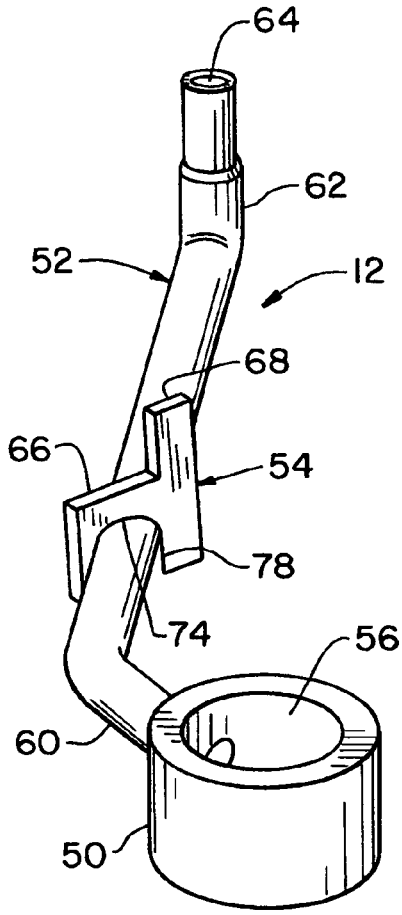
FIG. 5 is a perspective view of the piston cooling nozzle of FIGS. 1-4.

As most easily seen in FIGS. 5 and 6, bracket 54 is positioned at an acute angle $\alpha$ relative to longitudinal axis 76 of tube 52. Bracket 54 is positioned at an angle $\alpha$ of approximately 47.5° which places the face of projection 68 generally flat against ID 42 of cylinder liner 16. The value of angle $\alpha$ may vary dependent upon the specific configuration of PCN 12, the positioning of PCN 12 relative to ID 42 and/or the value of ID 42. For example, the value of angle $\alpha$ may vary between approximately 35-60°.

Corresponding to the orientation angle $\alpha$ between bracket 54 and tube 52, opposing edge 74 is formed with a pair of edge faces 78 (one of which is shown in FIG. 8) which are likewise formed at the same angle $\alpha$ relative to the front face of bracket 54. This allows edge faces 78 to lie substantially parallel and adjacent to the outer wall of tube 52, which in turn provides a larger face for effective brazing between bracket 54 and tube 52.

To position PCN 12 relative to cooling gallery 44, mount 50 is positioned relative to an opening in communication with oil rifle 30, and bolt 58 is threaded into the opening but not completely tightened. Bracket 54 is positioned such that side wall 70 of projection 68 engages against ID 42 of cylinder liner 16. An optional second projection 72 can be used for captivating bottom end 48 of cylinder liner 16, and an optional notch (not shown) can be formed in bottom end 48 for captivating tube 52. A torque wrench is then used to tighten bolt 58 to a predetermined torque value. To avoid vibrations between cylinder liner 16 and PCN 12, it is possible to configure PCN 12 such that tube 52 is deflected slightly upon tightening bolt 58 to the desired torque value. Nozzle outlet 64 of PCN 12 is then in the proper orientation to direct a spray of oil into cooling gallery 44. During operation of IC engine 10, oil flows from oil rifle 30 through PCN 12 and is discharged from nozzle outlet 64 into cooling gallery 44.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An internal combustion engine, comprising:

an engine block including an oil rifle;

a cylinder liner carried by said engine block, said cylinder liner including a bottom end; and a piston cooling nozzle coupled with said engine block, said piston cooling nozzle including an inlet in communication with said oil rifle, a tube, and a bracket coupled with said tube, said bracket engaging said bottom end of said cylinder liner, wherein said bracket has an edge with a projection engaging said bottom end of said cylinder liner; wherein said projection has a side wall engaging an inside diameter of said cylinder liner at said bottom end.

2. The internal combustion engine of claim 1, wherein said bracket is metallurgically bonded to said tube.

3. The internal combustion engine of claim 2, wherein said bracket is brazed to said tube.

4. The internal combustion engine of claim 1, wherein said bracket has an opposing edge with a shape corresponding to an outer wall of said tube.

5. The internal combustion engine of claim 4, wherein said opposing edge has a generally semi-circular shape.

6. The internal combustion engine of claim 5, wherein said bracket is positioned at an acute angle relative to a longitudinal axis of said tube.

7. The internal combustion engine of claim 1, wherein said bracket is positioned at an acute angle of between approximately 35° to 60° relative to a longitudinal axis of said tube.

8. The internal combustion engine of claim 7, wherein said bracket is positioned at an acute angle of approximately 47.5° relative to a longitudinal axis of said tube.

9. A piston cooling nozzle for spraying oil into an undercrown cooling gallery of a piston which is reciprocally carried within a cylinder liner of an internal combustion engine, said piston cooling nozzle comprising:

a tube coupled with said mount and terminating at a nozzle outlet; and a bracket metallurgically bonded with said tube, said bracket having a projection for engaging a bottom end of the cylinder liner, wherein said projection has a side wall for engaging an inside diameter of the cylinder liner.

10. The piston cooling nozzle of claim 9, wherein said bracket is brazed to said tube.

11. The piston cooling nozzle of claim 9, wherein said bracket has an edge with a shape corresponding to an outer wall of said tube.

12. The piston cooling nozzle of claim 11, wherein said edge has a generally semi-circular shape.

13. The piston cooling nozzle of claim 12, wherein said bracket is positioned at an acute angle relative to a longitudinal axis of said tube.

14. The piston cooling nozzle of claim 9, wherein said bracket is positioned at an acute angle of between approximately 35° to 60° relative to a longitudinal axis of said tube.

15. The piston cooling nozzle of claim 14, wherein said bracket is positioned at an acute angle of approximately 47.5° relative to a longitudinal axis of said tube.

16. A method of positioning a piston cooling nozzle relative to an undercrown cooling gallery of a piston in an internal combustion engine, comprising:

positioning a mount of said piston cooling nozzle on an engine block such that an inlet of said piston cooling nozzle is in communication with an oil rifle in said engine block;

locating a tube extending from said mount such that a bracket coupled with said tube engages a bottom end of a cylinder liner, wherein said bracket includes a projection, and said locating step comprises engaging said projection against an inside diameter of the cylinder liner; and coupling said mount to the engine block.

17. The method of positioning a piston cooling nozzle of claim 16, where said projection has a side wall, and said locating step comprises engaging said side wall against the inside diameter of the cylinder liner.

18. An internal combustion engine, comprising:

an engine block including an oil rifle;

a cylinder liner carried by said engine block, said cylinder liner including a bottom end; and a piston cooling nozzle coupled with said engine block, said piston cooling nozzle including an inlet in communication with said oil rifle, a tube, and a bracket coupled with said tube, said bracket engaging said bottom end of said cylinder liner, wherein said bracket has a generally h-shaped configuration.

19. A piston cooling nozzle for spraying oil into an undercrown cooling gallery of a piston which is reciprocally carried within a cylinder liner of an internal combustion engine, said piston cooling nozzle comprising:

a tube coupled with said mount and terminating at a nozzle outlet;

a bracket metallurgically bonded with said tube, said bracket having a projection for engaging a bottom end of the cylinder liner, wherein said bracket has a generally h-shaped configuration.

* * * * *